US005149100A

United States Patent [19]

Melvin et al.

[11] Patent Number: 5,149,100

[45] Date of Patent: Sep. 22, 1992

[54] GOLF BALL

[75] Inventors: Terence Melvin, Somers, Conn.; Joseph F. Stiefel, Shrewsbury, Mass.

[73] Assignee: Lisco, Inc., Tampa, Fla.

[21] Appl. No.: 716,465

[22] Filed: Jun. 17, 1991

[51] Int. Cl.[5] ..... A63B 37/14

[52] U.S. Cl. ..... 273/232; 40/327

[58] Field of Search ..... 273/232, 213, 62, 220; 40/327; D21/205

[56] References Cited

U.S. PATENT DOCUMENTS

| | | | |
|---|---|---|---|
| Re. 25,427 | 7/1963 | Harkins | 273/230 |
| D. 107,066 | 11/1937 | Cavignac | 273/232 |
| D. 228,394 | 9/1973 | Martin et al. | D34/5 QQ |
| D. 243,866 | 3/1977 | Shaw et al. | D34/5 QQ |
| D. 247,685 | 4/1978 | Haines et al. | D34/5 QQ |
| 878,254 | 2/1908 | Taylor | 273/232 |
| 906,932 | 12/1908 | Riblet | 273/233 |
| 922,773 | 5/1909 | Kempshall | 273/232 |
| 985,741 | 2/1911 | Harvey | 273/220 |
| 1,182,605 | 5/1916 | Wadsworth | 273/232 |
| 1,265,036 | 7/1918 | Bendelow | 273/233 |
| 1,286,834 | 12/1918 | Taylor | 273/232 |
| 1,418,220 | 5/1922 | White | 273/232 |
| 1,482,232 | 1/1924 | Hazeltine | 273/232 |
| 1,656,408 | 1/1928 | Young | 273/232 |
| 1,666,699 | 4/1928 | Hagen | 273/232 |
| 1,681,167 | 8/1928 | Beldam | 273/232 |
| 1,716,435 | 6/1929 | Fotheringham | 273/232 |
| 1,855,448 | 4/1932 | Hazeltine | 273/232 |
| 2,002,726 | 5/1935 | Young | 273/62 |
| 2,106,704 | 2/1938 | Davis | 273/62 |
| 2,643,125 | 6/1953 | Juve | 273/235 |
| 2,728,576 | 12/1955 | Martin et al. | 273/232 |
| 2,730,159 | 1/1956 | Semegen | 273/233 |
| 2,741,480 | 4/1956 | Smith | 273/227 |
| 2,861,810 | 11/1958 | Veatch | 273/213 |
| 2,997,302 | 8/1961 | Smith | 273/235 |
| 3,031,194 | 4/1962 | Strayer | 273/213 |
| 3,819,190 | 6/1974 | Nepela et al. | 273/232 |
| 3,940,145 | 2/1976 | Gentiluomo | 273/218 |
| 4,090,716 | 5/1978 | Martin et al. | 273/232 |
| 4,141,559 | 2/1979 | Melvin et al. | 273/220 |
| 4,142,727 | 3/1979 | Shaw et al. | 273/232 |
| 4,235,441 | 11/1980 | Ciccarello | 273/213 |
| 4,256,304 | 3/1981 | Smith et al. | 273/60 B |
| 4,258,921 | 3/1981 | Worst | 273/232 |
| 4,266,773 | 5/1981 | Treadwell | 273/232 |
| 4,284,276 | 8/1981 | Worst | 273/232 |
| 4,346,898 | 8/1982 | Badke | 273/232 |
| 4,560,168 | 12/1985 | Aoyama | 273/232 |
| 4,653,758 | 3/1987 | Solheim | 273/232 |
| 4,660,834 | 4/1987 | Carrigan | 273/176 AB |
| 4,681,323 | 7/1987 | Alaki et al. | 273/232 |
| 4,720,111 | 1/1988 | Yamada | 273/232 |
| 4,722,529 | 2/1988 | Shaw et al. | 273/232 |

(List continued on next page.)

FOREIGN PATENT DOCUMENTS

| | | | |
|---|---|---|---|
| 4774 | of 1892 | United Kingdom | 273/62 |
| 4360 | of 1898 | United Kingdom | 273/232 |
| 20778 | of 1911 | United Kingdom | 273/232 |
| 3012 | of 1912 | United Kingdom | 273/232 |
| 22179 | of 1912 | United Kingdom | 273/232 |
| 645 | of 1914 | United Kingdom | 273/232 |
| 189551 | 9/1921 | United Kingdom | 273/232 |
| 377354 | 5/1931 | United Kingdom | 273/232 |
| 420410 | 1/1934 | United Kingdom | 273/62 |

*Primary Examiner*—George J. Marlo

*Attorney, Agent, or Firm*—Donald R. Bahr; John E. Benoit

[57] ABSTRACT

A dimpled configuration for a golf ball wherein each hemisphere has substantially the same dimple pattern, the dimple pattern comprising a dimple located at each pole, a hexagon formation of dimples comprising six substantially equally spaced lines of dimples radiating outwardly from the pole dimple to thereby define six triangular areas in the hexagon formation, six substantially equally spaced pentagon formations of dimples interposed between the hexagon formation of dimples and the equator of the ball, one side of each pentagon formation being substantially parallel to one side of the hexagon formation, and additional dimples located between the lines of the hexagon, pentagon, and equator.

5 Claims, 2 Drawing Sheets

U.S PATENT DOCUMENTS

| | | | |
|---|---|---|---|
| 4,729,567 | 3/1988 | Oka et al. | 273/232 |
| 4,729,861 | 3/1988 | Lynch et al. | 264/219 |
| 4,744,564 | 5/1988 | Yamada | 273/232 |
| 4,762,326 | 8/1988 | Gobush | 273/232 |
| 4,765,626 | 8/1988 | Gobush | 273/232 |
| 4,772,026 | 9/1988 | Gobush | 273/232 |
| 4,787,638 | 11/1988 | Kobayashi | 273/232 |
| 4,804,189 | 2/1989 | Gobush | 273/232 |
| 4,813,677 | 3/1989 | Oka et al. | 273/232 |
| 4,830,378 | 5/1989 | Aoyama | 273/232 |
| 4,840,381 | 6/1989 | Ihara et al. | 273/232 |
| 4,844,472 | 7/1989 | Ihara | 273/232 |
| 4,848,766 | 7/1989 | Oka et al. | 273/232 |
| 4,858,923 | 8/1989 | Gobush et al. | 273/62 |
| 4,867,459 | 9/1989 | Ihara | 273/232 |
| 4,869,512 | 9/1989 | Nomura et al. | 273/232 |
| 4,877,252 | 10/1989 | Shaw | 273/232 |
| 4,880,241 | 11/1989 | Melvin et al. | 273/232 |
| 4,886,277 | 12/1989 | Mackey | 273/232 |
| 4,915,389 | 4/1990 | Ihara | 273/232 |
| 4,915,390 | 4/1990 | Gobush et al. | 273/232 |
| 4,921,255 | 5/1990 | Taylor | 273/232 |
| 4,925,193 | 5/1990 | Melvin et al. | 273/232 |
| 4,932,664 | 6/1990 | Pocklington et al. | 273/232 |
| 4,936,587 | 6/1990 | Lynch et al. | 273/232 |
| 4,949,976 | 8/1990 | Gobush | 273/232 |
| 4,960,283 | 10/1990 | Gobush | 273/232 |
| 4,968,038 | 11/1990 | Yamada | 273/232 |
| 4,971,330 | 11/1990 | Morell | 273/232 |
| 4,973,057 | 11/1990 | Morell | 273/232 |
| 4,974,853 | 12/1990 | Morell | 273/232 |
| 4,974,854 | 12/1990 | Morell | 273/232 |
| 4,974,855 | 12/1990 | Morell | 273/232 |
| 4,974,856 | 12/1990 | Morell | 273/232 |
| 4,979,747 | 12/1990 | Jonkouski | 273/232 |
| 4,982,964 | 1/1991 | Morell | 273/232 |
| 4,991,852 | 2/1991 | Pattison | 273/232 |
| 4,998,733 | 3/1991 | Lee | 273/232 |
| 5,009,427 | 4/1991 | Stiefel et al. | 273/232 |
| 5,009,428 | 4/1991 | Yamagishi et al. | 273/232 |
| 5,016,887 | 5/1991 | Jonkouski | 273/232 |
| 5,018,741 | 5/1991 | Stiefel et al. | 273/232 |
| 5,024,444 | 6/1991 | Yamagishi et al. | 273/232 |
| 5,046,742 | 9/1991 | Mackey | 273/232 |

GOLF BALL

This invention relates generally to golf balls and more particularly to a specific arrangement of the dimples on a golf ball.

It is generally known that for any given selected number of dimples on a golf ball, it is desirable that the area of the surface of the golf ball covered by the dimples be a maximum in order to provide the best flight characteristics for a golf ball. In British Patent Provisional Specification Serial No. 377,354, filed May 22, 1931, in the name of John Vernon Pugh, there is disclosed the fact that by the use of an icosahedral lattice for defining dimple patterns on a golf ball it is possible to make a geometrically symmetrical ball. This icosahedral lattice is developed by the known division of a sphere or spherical surface into like areas determined by an inscribed regular polyhedron such as an icosahedron. The Pugh specification specifically details the means of plotting the icosahedron on the surface of the golf ball and, accordingly, will not be dealt with in detail here. Thus, with a selected number and size of dimples placed in this icosahedral pattern, the area of the surface of the ball covered by the dimples is fixed.

A problem arises with the Pugh icosahedron golf ball in that there is no equatorial line on the ball which does not pass through some of the dimples on the ball. Since golf balls are molded and manufactured by using two hemispherical half molds normally having straight edges, the ball as it comes from the mold has a flash line about the equatorial line created by the two hemispheres of the mold. Such molding results in a clear flash line. Even if the ball could be molded with dimples on the flash line, the ball could not be properly cleaned and finished in any efficient manner since the flash could not be cleaned from the bottom of the dimple without individual treatment of each dimple.

The Pugh ball is geometrically symmetrical. Any changes in dimple location which affect the aerodynamic symmetry under U.S.G.A. standards will render the ball illegal for sanctioned play. Many proposals have been made and balls have been constructed with a modification of the Pugh icosahedral pattern so as to provide an equatorial line which is free of dimples. Again, it is emphasized that any such modification must be aerodynamically symmetrical.

Other dimple patterns have been proposed which use various geometrical arrangements. U.S. Pat. No. 4,932,664 to Pocklington et al discloses a golf ball having a dimple configuration arranged in these different patterns comprising a pentagon at each pole, five trapezoid formations in each hemisphere, and five triangular formations in each hemisphere.

U.S.G.A. rules of golf require that the ball shall be designed and manufactured to perform in general as if it were aerodynamically symmetrical. A golf ball which is dimpled in some manner may be geometrically symmetrical and not aerodynamically symmetrical. A perfect example of a golf ball which is both geometrically symmetrical and aerodynamically symmetrical is a smooth sphere. As is well known, this ball is not capable of providing the necessary performance required in present-day golf. To conform, all balls must be aerodynamically symmetrical. This symmetry is determined by actual tests of the ball as it is being struck by a machine which belongs to the U.S.G.A.

It has also been found that it is desirable to cover as much of the surface as possible with the dimples. While a great deal of the surface may be covered by making the dimples quite small, it has been found that this imparts some undesirable characteristics to the ball. At the same time, when larger diameter dimples are used and all the dimples are the same size, they should be arranged so as to cover the maximum surface area of the ball.

Accordingly, it is an object of the present invention to provide a dimpled golf ball wherein a substantially maximum area of the surface is covered by dimples.

It is yet another object of the present invention to provide a dimpled golf ball wherein the dimples are specifically arranged using a hexagon/pentagon arrangement.

These and other objects of the invention will become apparent from the following description taken together with the drawings.

SUMMARY OF THE INVENTION

The present invention provides a golf ball having a dimple configuration wherein each hemisphere has substantially the same dimple pattern, the dimple pattern comprising a dimple located at each pole, a hexagon formation of dimples comprising six substantially equally spaced lines of dimples radiating outwardly from the pole dimple to thereby define six triangular areas in the hexagon formation, six substantially equally spaced pentagon formations of dimples interposed between the hexagon formation of dimples and the equator of the ball, one side of each pentagon formation being substantially parallel to one side of the hexagon formation, with additional dimples located between the lines of the hexagon, pentagon, and equator to substantially cover the surface of the ball.

DETAILED DESCRIPTION OF THE PREFERRED EMBODIMENT

Figure 1:
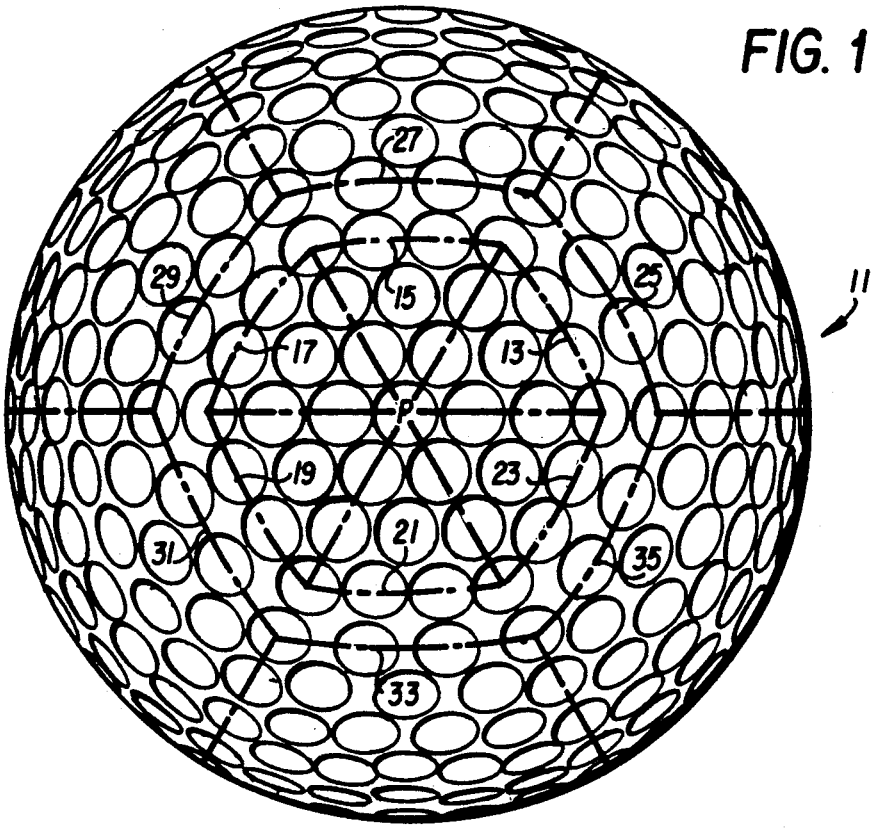
FIG. 1 is a top plan view of the ball of the present invention taken from one of the poles thereof.
Figure 2:
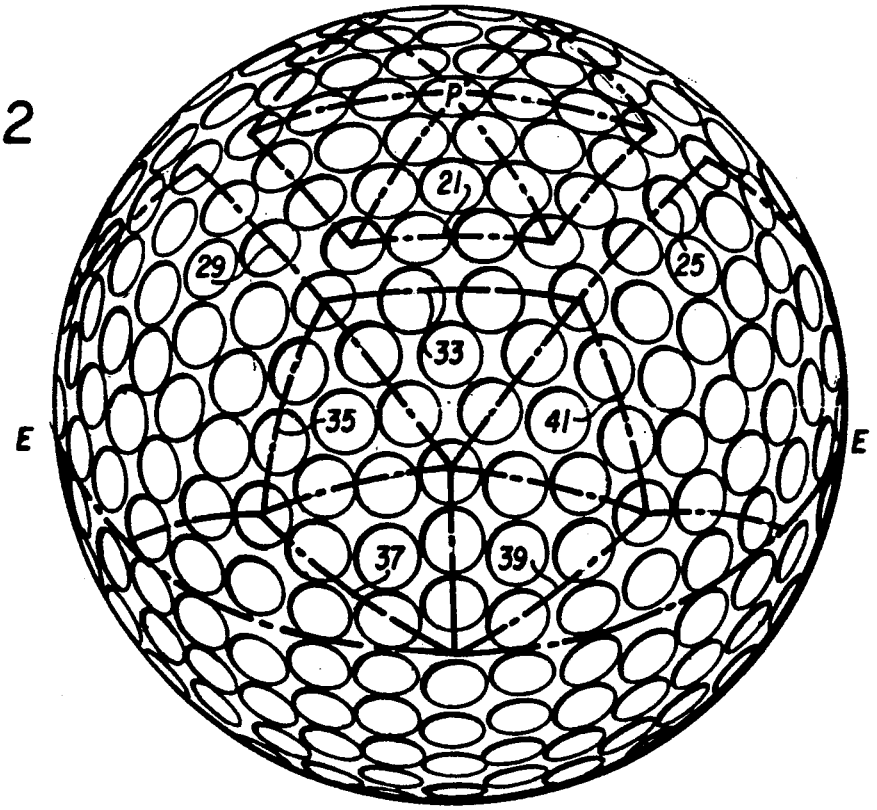
FIG. 2 is a plan view taken along an offset line from the equatorial line of the ball of FIG. 1.
Figure 3:
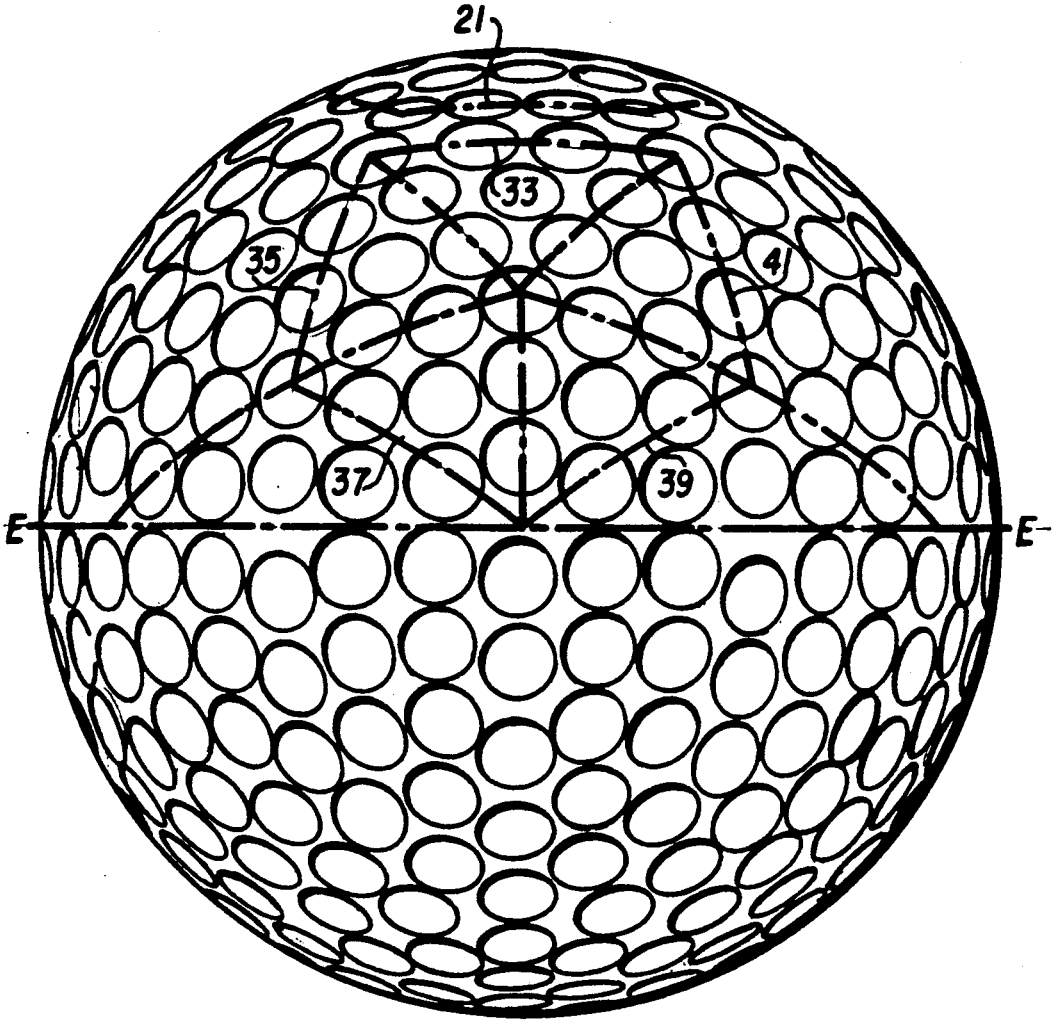
FIG. 3 is a plan view taken along the equatorial line of the ball of FIG. 1.

Referring to FIGS. 1, 2, and 3, there is shown a golf ball having two poles P and an equatorial line E—E which effectively divides the ball into hemispheres. Each hemisphere has dimple patterns which are substantially identical, with the equator establishing a dimple-free line about the ball.

Each hemisphere has a dimple located at the pole P. A hexagon formation of dimples is formed by having six substantially equally spaced lines of dimples radiating outwardly from the pole P. Each of the lines of the dimples contains three dimples in addition to the polar dimple P. The last dimples comprising the radiating lines are interconnected by a plurality of dimples so as to form a hexagon having sides 13, 15, 17, 19, 21, and 23 facing the equatorial line. In the illustration of the preferred embodiment as shown, there are two dimples between each of the dimples at the ends of the radiating lines.

The above configuration effectively forms six equal triangles and the triangles all include a further dimple within each triangle.

Six substantially equally spaced pentagon formations are interposed between the hexagon formation of dimples and the equator, with one side of each of the pentagons such as sides 25, 27, 29, 31, 33, and 34 being substantially parallel to adjacent sides 13, 15, 17, 19, 21, and 23 of the hexagon dimple formation.

FIG. 3 shows one of the pentagons with sides 33, 35, 37, 39, and 41, with one of the points of the pentagon being adjacent the equator E—E. As shown, this leaves a space between the lower legs of the pentagons and the equator, which space is filled with dimples (in this particular embodiment there are three dimples between each of the pentagons).

As is usually the case in forming any dimple configurations about a ball, some slight adjustments are made with the dimples after the basic pattern is arranged so as to avoid overlapping of the dimples and yet covering as much surface of the ball as possible.

In the preferred embodiment, using a standard size golf ball, there are 211 dimples in each hemispherical surface, providing a ball having a total of 422 dimples. In the preferred configuration shown, the dimples all have diameters of substantially 0.140 inch and are all of the same diameter and depth. The depth of the dimples is substantially 0.0098 inch.

With the ball being of a standard diameter and having 422 dimples of 0.140 inch in diameter, the following are the physical coordinates of each of the dimples in one hemisphere. As previously stated, the two hemispheres are substantially identical.

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 1 | 0 | 0 | 0 | 0 | 0 | 0 | 0.140 |
| 2 | 9 | 53 | 30 | 0 | 0 | 0 | 0.140 |
| 3 | 9 | 53 | 30 | 60 | 0 | 0 | 0.140 |
| 4 | 9 | 53 | 30 | 120 | 0 | 0 | 0.140 |
| 5 | 9 | 53 | 30 | 180 | 0 | 0 | 0.140 |
| 6 | 9 | 53 | 30 | 240 | 0 | 0 | 0.140 |
| 7 | 9 | 53 | 30 | 300 | 0 | 0 | 0.140 |
| 8 | 17 | 18 | 0 | 30 | 0 | 0 | 0.140 |
| 9 | 17 | 18 | 0 | 90 | 0 | 0 | 0.140 |
| 10 | 17 | 18 | 0 | 150 | 0 | 0 | 0.140 |
| 11 | 17 | 18 | 0 | 210 | 0 | 0 | 0.140 |
| 12 | 17 | 18 | 0 | 270 | 0 | 0 | 0.140 |
| 13 | 17 | 18 | 0 | 330 | 0 | 0 | 0.140 |
| 14 | 19 | 46 | 45 | 0 | 0 | 0 | 0.140 |
| 15 | 19 | 46 | 45 | 60 | 0 | 0 | 0.140 |
| 16 | 19 | 46 | 45 | 120 | 0 | 0 | 0.140 |
| 17 | 19 | 46 | 45 | 180 | 0 | 0 | 0.140 |
| 18 | 19 | 46 | 45 | 240 | 0 | 0 | 0.140 |
| 19 | 19 | 46 | 45 | 300 | 0 | 0 | 0.140 |
| 20 | 26 | 39 | 45 | 19 | 18 | 15 | 0.140 |
| 21 | 26 | 39 | 45 | 40 | 41 | 30 | 0.140 |
| 22 | 26 | 39 | 45 | 79 | 18 | 15 | 0.140 |
| 23 | 26 | 39 | 45 | 100 | 41 | 30 | 0.140 |
| 24 | 26 | 39 | 45 | 139 | 18 | 15 | 0.140 |
| 25 | 26 | 39 | 45 | 160 | 41 | 30 | 0.140 |
| 26 | 26 | 39 | 45 | 199 | 18 | 15 | 0.140 |
| 27 | 26 | 39 | 45 | 220 | 41 | 30 | 0.140 |
| 28 | 26 | 39 | 45 | 259 | 18 | 15 | 0.140 |
| 29 | 26 | 39 | 45 | 280 | 41 | 30 | 0.140 |
| 30 | 26 | 39 | 45 | 319 | 18 | 15 | 0.140 |
| 31 | 26 | 39 | 45 | 340 | 41 | 30 | 0.140 |
| 32 | 29 | 40 | 15 | 0 | 0 | 0 | 0.140 |
| 33 | 29 | 40 | 15 | 60 | 0 | 0 | 0.140 |
| 34 | 29 | 40 | 15 | 120 | 0 | 0 | 0.140 |
| 35 | 29 | 40 | 15 | 180 | 0 | 0 | 0.140 |
| 36 | 29 | 40 | 15 | 240 | 0 | 0 | 0.140 |
| 37 | 29 | 40 | 15 | 300 | 0 | 0 | 0.140 |
| 38 | 36 | 35 | 15 | 20 | 30 | 45 | 0.140 |
| 39 | 36 | 35 | 15 | 39 | 29 | 15 | 0.140 |
| 40 | 36 | 35 | 15 | 80 | 30 | 45 | 0.140 |
| 41 | 36 | 35 | 15 | 99 | 29 | 15 | 0.140 |
| 42 | 36 | 35 | 15 | 140 | 30 | 45 | 0.140 |
| 43 | 36 | 35 | 15 | 159 | 29 | 15 | 0.140 |
| 44 | 36 | 35 | 15 | 200 | 30 | 45 | 0.140 |
| 45 | 36 | 35 | 15 | 219 | 29 | 15 | 0.140 |
| 46 | 36 | 35 | 15 | 260 | 30 | 45 | 0.140 |
| 47 | 36 | 35 | 15 | 279 | 29 | 15 | 0.140 |
| 48 | 36 | 35 | 15 | 320 | 30 | 45 | 0.140 |
| 49 | 36 | 35 | 15 | 339 | 29 | 15 | 0.140 |
| 50 | 39 | 28 | 15 | 0 | 0 | 0 | 0.140 |
| 51 | 39 | 28 | 15 | 60 | 0 | 0 | 0.140 |
| 52 | 39 | 28 | 15 | 120 | 0 | 0 | 0.140 |
| 53 | 39 | 28 | 15 | 180 | 0 | 0 | 0.140 |
| 54 | 39 | 28 | 15 | 240 | 0 | 0 | 0.140 |
| 55 | 39 | 28 | 15 | 300 | 0 | 0 | 0.140 |
| 56 | 44 | 37 | 15 | 30 | 0 | 0 | 0.140 |
| 57 | 44 | 37 | 15 | 90 | 0 | 0 | 0.140 |
| 58 | 44 | 37 | 15 | 150 | 0 | 0 | 0.140 |
| 59 | 44 | 37 | 15 | 210 | 0 | 0 | 0.140 |
| 60 | 44 | 37 | 15 | 270 | 0 | 0 | 0.140 |
| 61 | 44 | 37 | 15 | 330 | 0 | 0 | 0.140 |

-continued

| DIMPLE NUMBER | LATITUDE Degrees | Minutes | Seconds | LONGITUDE Degrees | Minutes | Seconds | DIMPLE DIAMETER |
|---|---|---|---|---|---|---|---|
| 62 | 45 | 27 | 0 | 12 | 25 | 15 | 0.140 |
| 63 | 45 | 27 | 0 | 47 | 34 | 45 | 0.140 |
| 64 | 45 | 27 | 0 | 72 | 25 | 15 | 0.140 |
| 65 | 45 | 27 | 0 | 107 | 34 | 45 | 0.140 |
| 66 | 45 | 27 | 0 | 132 | 25 | 15 | 0.140 |
| 67 | 45 | 27 | 0 | 167 | 34 | 45 | 0.140 |
| 68 | 45 | 27 | 0 | 192 | 25 | 15 | 0.140 |
| 69 | 45 | 27 | 0 | 227 | 34 | 45 | 0.140 |
| 70 | 45 | 27 | 0 | 252 | 25 | 15 | 0.140 |
| 71 | 45 | 27 | 0 | 287 | 34 | 45 | 0.140 |
| 72 | 45 | 27 | 0 | 312 | 25 | 15 | 0.140 |
| 73 | 45 | 27 | 0 | 347 | 34 | 45 | 0.140 |
| 74 | 50 | 43 | 45 | 0 | 0 | 0 | 0.140 |
| 75 | 50 | 43 | 45 | 60 | 0 | 0 | 0.140 |
| 76 | 50 | 43 | 45 | 120 | 0 | 0 | 0.140 |
| 77 | 50 | 43 | 45 | 180 | 0 | 0 | 0.140 |
| 78 | 50 | 43 | 45 | 240 | 0 | 0 | 0.140 |
| 79 | 50 | 43 | 45 | 300 | 0 | 0 | 0.140 |
| 80 | 53 | 8 | 45 | 22 | 45 | 0 | 0.140 |
| 81 | 53 | 8 | 45 | 37 | 15 | 0 | 0.140 |
| 82 | 53 | 8 | 45 | 82 | 45 | 0 | 0.140 |
| 83 | 53 | 8 | 45 | 97 | 15 | 0 | 0.140 |
| 84 | 53 | 8 | 45 | 142 | 45 | 0 | 0.140 |
| 85 | 53 | 8 | 45 | 157 | 15 | 0 | 0.140 |
| 86 | 53 | 8 | 45 | 202 | 45 | 0 | 0.140 |
| 87 | 53 | 8 | 45 | 217 | 15 | 0 | 0.140 |
| 88 | 53 | 8 | 45 | 262 | 45 | 0 | 0.140 |
| 89 | 53 | 8 | 45 | 277 | 15 | 0 | 0.140 |
| 90 | 53 | 8 | 45 | 322 | 45 | 0 | 0.140 |
| 91 | 53 | 8 | 45 | 337 | 15 | 0 | 0.140 |
| 92 | 55 | 57 | 45 | 10 | 46 | 30 | 0.140 |
| 93 | 55 | 57 | 45 | 49 | 13 | 30 | 0.140 |
| 94 | 55 | 57 | 45 | 70 | 46 | 30 | 0.140 |
| 95 | 55 | 57 | 45 | 109 | 13 | 30 | 0.140 |
| 96 | 55 | 57 | 45 | 130 | 46 | 30 | 0.140 |
| 97 | 55 | 57 | 45 | 169 | 13 | 30 | 0.140 |
| 98 | 55 | 57 | 45 | 190 | 46 | 30 | 0.140 |
| 99 | 55 | 57 | 45 | 229 | 13 | 30 | 0.140 |
| 100 | 55 | 57 | 45 | 250 | 46 | 30 | 0.140 |
| 101 | 55 | 57 | 45 | 289 | 13 | 30 | 0.140 |
| 102 | 55 | 57 | 45 | 310 | 46 | 30 | 0.140 |
| 103 | 55 | 57 | 45 | 349 | 13 | 30 | 0.140 |
| 104 | 61 | 25 | 45 | 30 | 0 | 0 | 0.140 |
| 105 | 61 | 25 | 45 | 90 | 0 | 0 | 0.140 |
| 106 | 61 | 25 | 45 | 150 | 0 | 0 | 0.140 |
| 107 | 61 | 25 | 45 | 210 | 0 | 0 | 0.140 |
| 108 | 61 | 25 | 45 | 270 | 0 | 0 | 0.140 |
| 109 | 61 | 25 | 45 | 330 | 0 | 0 | 0.140 |
| 110 | 61 | 59 | 30 | 0 | 0 | 0 | 0.140 |
| 111 | 61 | 59 | 30 | 60 | 0 | 0 | 0.140 |
| 112 | 61 | 59 | 30 | 120 | 0 | 0 | 0.140 |
| 113 | 61 | 59 | 30 | 180 | 0 | 0 | 0.140 |
| 114 | 61 | 59 | 30 | 240 | 0 | 0 | 0.140 |
| 115 | 61 | 59 | 30 | 300 | 0 | 0 | 0.140 |
| 116 | 64 | 24 | 45 | 19 | 34 | 0 | 0.140 |
| 117 | 64 | 24 | 45 | 40 | 26 | 0 | 0.140 |
| 118 | 64 | 24 | 45 | 79 | 34 | 0 | 0.140 |
| 119 | 64 | 24 | 45 | 100 | 26 | 0 | 0.140 |
| 120 | 64 | 24 | 45 | 139 | 34 | 0 | 0.140 |
| 121 | 64 | 24 | 45 | 160 | 26 | 0 | 0.140 |
| 122 | 64 | 24 | 45 | 199 | 34 | 0 | 0.140 |
| 123 | 64 | 24 | 45 | 220 | 26 | 0 | 0.140 |
| 124 | 64 | 24 | 45 | 259 | 34 | 0 | 0.140 |
| 125 | 64 | 24 | 45 | 280 | 26 | 0 | 0.140 |
| 126 | 64 | 24 | 45 | 319 | 34 | 0 | 0.140 |
| 127 | 64 | 24 | 45 | 340 | 26 | 0 | 0.140 |
| 128 | 65 | 56 | 45 | 9 | 25 | 45 | 0.140 |
| 129 | 65 | 56 | 45 | 50 | 34 | 15 | 0.140 |
| 130 | 65 | 56 | 45 | 69 | 25 | 45 | 0.140 |
| 131 | 65 | 56 | 45 | 110 | 34 | 15 | 0.140 |
| 132 | 65 | 56 | 45 | 129 | 25 | 45 | 0.140 |
| 133 | 65 | 56 | 45 | 170 | 34 | 15 | 0.140 |
| 134 | 65 | 56 | 45 | 189 | 25 | 45 | 0.140 |
| 135 | 65 | 56 | 45 | 230 | 34 | 15 | 0.140 |
| 136 | 65 | 56 | 45 | 249 | 25 | 45 | 0.140 |
| 137 | 65 | 56 | 45 | 290 | 34 | 15 | 0.140 |
| 138 | 65 | 56 | 45 | 309 | 25 | 45 | 0.140 |
| 139 | 65 | 56 | 45 | 350 | 34 | 15 | 0.140 |
| 140 | 71 | 35 | 45 | 30 | 0 | 0 | 0.140 |
| 141 | 71 | 35 | 45 | 90 | 0 | 0 | 0.140 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 142 | 71 | 35 | 45 | 150 | 0 | 0 | 0.140 |
| 143 | 71 | 35 | 45 | 210 | 0 | 0 | 0.140 |
| 144 | 71 | 35 | 45 | 270 | 0 | 0 | 0.140 |
| 145 | 71 | 35 | 45 | 330 | 0 | 0 | 0.140 |
| 146 | 73 | 15 | 15 | 0 | 0 | 0 | 0.140 |
| 147 | 73 | 15 | 15 | 60 | 0 | 0 | 0.140 |
| 148 | 73 | 15 | 15 | 120 | 0 | 0 | 0.140 |
| 149 | 73 | 15 | 15 | 180 | 0 | 0 | 0.140 |
| 150 | 73 | 15 | 15 | 240 | 0 | 0 | 0.140 |
| 151 | 73 | 15 | 15 | 300 | 0 | 0 | 0.140 |
| 152 | 74 | 31 | 0 | 20 | 7 | 30 | 0.140 |
| 153 | 74 | 31 | 0 | 39 | 52 | 45 | 0.140 |
| 154 | 74 | 31 | 0 | 80 | 7 | 30 | 0.140 |
| 155 | 74 | 31 | 0 | 99 | 52 | 45 | 0.140 |
| 156 | 74 | 31 | 0 | 140 | 7 | 30 | 0.140 |
| 157 | 74 | 31 | 0 | 159 | 52 | 45 | 0.140 |
| 158 | 74 | 31 | 0 | 200 | 7 | 30 | 0.140 |
| 159 | 74 | 31 | 0 | 219 | 52 | 45 | 0.140 |
| 160 | 74 | 31 | 0 | 260 | 7 | 30 | 0.140 |
| 161 | 74 | 31 | 0 | 279 | 52 | 45 | 0.140 |
| 162 | 74 | 31 | 0 | 320 | 7 | 30 | 0.140 |
| 163 | 74 | 31 | 0 | 339 | 52 | 45 | 0.140 |
| 164 | 75 | 29 | 45 | 9 | 59 | 15 | 0.140 |
| 165 | 75 | 29 | 45 | 50 | 0 | 45 | 0.140 |
| 166 | 75 | 29 | 45 | 69 | 59 | 15 | 0.140 |
| 167 | 75 | 29 | 45 | 110 | 0 | 45 | 0.140 |
| 168 | 75 | 29 | 45 | 129 | 59 | 15 | 0.140 |
| 169 | 75 | 29 | 45 | 170 | 0 | 45 | 0.140 |
| 170 | 75 | 29 | 45 | 189 | 59 | 15 | 0.140 |
| 171 | 75 | 29 | 45 | 230 | 0 | 45 | 0.140 |
| 172 | 75 | 29 | 45 | 249 | 59 | 15 | 0.140 |
| 173 | 75 | 29 | 45 | 290 | 0 | 45 | 0.140 |
| 174 | 75 | 29 | 45 | 309 | 59 | 15 | 0.140 |
| 175 | 75 | 29 | 45 | 350 | 0 | 45 | 0.140 |
| 176 | 81 | 41 | 45 | 30 | 0 | 0 | 0.140 |
| 177 | 81 | 41 | 45 | 90 | 0 | 0 | 0.140 |
| 178 | 81 | 41 | 45 | 150 | 0 | 0 | 0.140 |
| 179 | 81 | 41 | 45 | 210 | 0 | 0 | 0.140 |
| 180 | 81 | 41 | 45 | 270 | 0 | 0 | 0.140 |
| 181 | 81 | 41 | 45 | 330 | 0 | 0 | 0.140 |
| 182 | 83 | 48 | 15 | 0 | 0 | 0 | 0.140 |
| 183 | 83 | 48 | 15 | 60 | 0 | 0 | 0.140 |
| 184 | 83 | 48 | 15 | 120 | 0 | 0 | 0.140 |
| 185 | 83 | 48 | 15 | 180 | 0 | 0 | 0.140 |
| 186 | 83 | 48 | 15 | 240 | 0 | 0 | 0.140 |
| 187 | 83 | 48 | 15 | 300 | 0 | 0 | 0.140 |
| 188 | 84 | 37 | 30 | 20 | 26 | 15 | 0.140 |
| 189 | 84 | 37 | 30 | 39 | 33 | 45 | 0.140 |
| 190 | 84 | 37 | 30 | 80 | 26 | 15 | 0.140 |
| 191 | 84 | 37 | 30 | 99 | 33 | 45 | 0.140 |
| 192 | 84 | 37 | 30 | 140 | 26 | 15 | 0.140 |
| 193 | 84 | 37 | 30 | 159 | 33 | 45 | 0.140 |
| 194 | 84 | 37 | 30 | 200 | 26 | 15 | 0.140 |
| 195 | 84 | 37 | 30 | 219 | 33 | 45 | 0.140 |
| 196 | 84 | 37 | 30 | 260 | 26 | 15 | 0.140 |
| 197 | 84 | 37 | 30 | 279 | 33 | 45 | 0.140 |
| 198 | 84 | 37 | 30 | 320 | 26 | 15 | 0.140 |
| 199 | 84 | 37 | 30 | 339 | 33 | 45 | 0.140 |
| 200 | 85 | 5 | 45 | 10 | 13 | 15 | 0.140 |
| 201 | 85 | 5 | 45 | 49 | 46 | 45 | 0.140 |
| 202 | 85 | 5 | 45 | 70 | 13 | 15 | 0.140 |
| 203 | 85 | 5 | 45 | 109 | 46 | 45 | 0.140 |
| 204 | 85 | 5 | 45 | 130 | 13 | 15 | 0.140 |
| 205 | 85 | 5 | 45 | 169 | 46 | 45 | 0.140 |
| 206 | 85 | 5 | 45 | 190 | 13 | 15 | 0.140 |
| 207 | 85 | 5 | 45 | 229 | 46 | 45 | 0.140 |
| 208 | 85 | 5 | 45 | 250 | 13 | 15 | 0.140 |
| 209 | 85 | 5 | 45 | 289 | 46 | 45 | 0.140 |
| 210 | 85 | 5 | 45 | 310 | 13 | 15 | 0.140 |
| 211 | 85 | 5 | 45 | 349 | 46 | 45 | 0.140 |

With this particular dimple configuration, and using the dimple size indicated, at least 73% of the surface of the ball is covered with dimples. The ball has the necessary symmetry and flight characteristics so as to meet U.S.G.A. requirements.

It is to be understood that the description and drawings are illustrative only since the scope of the invention is to be limited only by the following claims.

We claim:

1. A golf ball having a plurality of dimples formed on the spherical surface of the golf ball, said surface defining opposite poles and an equator midway between said poles dividing the surface into two hemispheres, each of said hemispheres having substantially the same dimple pattern, said dimple pattern comprising a dimple located at each pole;

a hexagon formation of dimples comprising six substantially equally spaced lines of dimples radiating outwardly from said pole and dimples between the outer ends of said liens to thereby define six triangular areas of dimples in said hexagon formation;

six substantially equally sized adjacent pentagon formations of dimples, each comprising five lines of dimples interposed between said hexagon formation of dimples and the equator, one side of each of said pentagon formations being substantially parallel top one side of said hexagon formation, each of said pentagon formations of dimples sharing a common line of dimples with adjacent pentagon formations of dimples; and additional dimples located within the liens of dimples defining said hexagon formations and said pentagon formation, and between said pentagon formations and said equator.

2. The golf ball of claim 1 wherein all dimples have substantially the same diameter.

3. The golf ball of claim 2 wherein there are 211 dimples in each hemisphere.

4. The golf ball of claim 2 wherein each dimple has a diameter of substantially 0.140 inch.

5. The golf ball of claim 2 wherein said dimples cover at least 73% of the surface of the ball.

* * * * *